US005160603A

United States Patent [19]

Rankel

[11] Patent Number: 5,160,603

[45] Date of Patent: Nov. 3, 1992

[54] CATALYTIC CRACKING WITH SULFUR COMPOUND ADDED TO THE FEED

[75] Inventor: Lillian A. Rankel, Princeton, N.J.

[73] Assignee: Mobil Oil Corporation, Fairfax, Va.

[21] Appl. No.: 668,571

[22] Filed: Mar. 13, 1991

[51] Int. Cl.[5] ..... C10G 55/00; C10G 57/00

[52] U.S. Cl. ..... 208/252; 208/73; 208/88; 208/90

[58] Field of Search ..... 208/73, 88, 90, 252

[56] References Cited

U.S. PATENT DOCUMENTS

| | | | |
|---|---|---|---|
| 2,902,430 | 9/1959 | Kimberlin, Jr. et al. | 208/90 |
| 4,233,138 | 11/1980 | Rollmann et al. | 208/106 |
| 4,256,567 | 3/1981 | Bartholic | 208/252 |
| 4,377,469 | 3/1983 | Shihabi | 208/111 |
| 4,430,206 | 2/1984 | Rankel | 208/251 |
| 4,895,636 | 1/1990 | Chen et al. | 208/113 |
| 4,988,434 | 1/1991 | Aldridge et al. | 208/88 |

OTHER PUBLICATIONS

"Degradation of Metalloporphyrins in heavy oils before and during Processing", Lillian A. Rankel, 1987, American Chemical Society, Chapter 16, pp. 257-264.

*Primary Examiner*—Theodore Morris
*Assistant Examiner*—Zeinab El-Arini
*Attorney, Agent, or Firm*—Alexander J. McKillop; Charles J. Speciale; Richard D. Stone

[57] ABSTRACT

A catalytic cracking process for heavy metals and asphaltene containing feed is disclosed. A reactive sulfur compound, preferably $H_2S$, is dissolved in the heavy feed and then kept at a temperature and for a time sufficient to at least partially decompose the metal containing compounds and also to reduce the molecular weight of the asphaltenes. Preferably a metal scavenging additive is added to the equilibrium catalyst. The additive will rapidly remove the thermal- and sulfur-treated metal containing compounds and prevent or minimize metals poisoning of the cracking catalyst. Sulfur induced cracking of heavy oil components reduces the viscosity of the heavy feed, and permits lower temperature to be used in the cracking reactor.

19 Claims, No Drawings

CATALYTIC CRACKING WITH SULFUR COMPOUND ADDED TO THE FEED

Catalytic cracking is a mature process which is used to convert heavy hydrocarbons to lighter hydrocarbons. There are two main variants of the process, fluidized catalytic cracking (FCC) and Thermofor or moving bed catalytic cracking (TCC).

In both processes, preheated feed contacts a hot regenerated cracking catalyst. The feed cracks to lighter products and deposits coke on the catalyst. The catalyst is regenerated or decoked with air and returned for reuse.

The catalytic cracking process as originally developed was intended to crack distillable materials. Because lighter products are more valuable than heavy products, there have been many attempts made at the barrel" of the feed in the cat cracker. Many catalytic cracking units operate with 5-20 wt % residuum added to the feed, some have up to 30-50 wt % resid. These heavy feed materials contain higher levels of metals (usually nickel and vanadium) which are catalyst poisons. The nickel and vanadium add a hydrogenation/-dehydrogenation function to the catalytic cracking catalyst, causing undesirable increases in production of hydrogen and light gases. The vanadium also acts as a cancer to destroy the zeolite based catalytic cracking catalyst.

Plank in U.S. Pat. No. 2,668,798, was one of the first to address the problem of poisoning of an amorphous cracking catalyst with nickel. He used steam and acid treatments of spent catalyst to remove nickel. This treatment was thought to be suitable for removal of other metal contaminants such as copper, iron, vanadium, and the like.

In U.S. Pat. No. 4,430,206 I reported on the use of $H_2S$, alone or mixed with hydrogen, to remove metallic contaminants such as selenium, arsenic, iron or sodium from hydrocarbonaceous feeds. The metal contaminants were poisons for downstream hydrotreating or hydroprocessing catalyst. 5000 psig were taught as suitable, the most preferred pressure for treatment was 200 to 2000 psig. Many experiments were run at 750 F. and 16-46.6 atmospheres, which showed that arsenic and selenium could be removed from shale oil. The As and Fe deposited on the walls of the reactor and Vycor glass, mostly as metal sulfide species. This work was not directly applicable to the problems of removing coordinated metal species, such as Ni and V encountered in FCC feeds, nor did it present any evidence that the process would work at low pressures conventionally found in catalytic cracking units.

Ni and V are especially troublesome in FCC processing. A discussion of the mechanism of vanadium poisoning is reported in Vanadium Poisoning of Cracking Catalysts, Wormsbecher et al, Journal of Catalysis 100. 130-137 (1986). This reference suggests that the high temperature, steam laden atmosphere of FCC regenerators converts $V_2O_5$ into 1-10 ppm of $H_3VO_4$. Addition of a basic alkaline earth solid, such as MgO or CaO, is proposed to neutralize this vanadic acid.

Some attempts have been made at adjusting FCC (or TCC) operation to accommodate higher metals levels. The Phillip's metals passivation process is a popular way of passivating the metal contaminants, particularly Ni present in the feed. Typically, antimony and tin compounds are added to the feed to passivate the nickel and vanadium, respectively. In metals passivation, metals accumulate on the catalyst, and their bad effects are or other materials.

Another approach, DEMET, involves removing catalyst from the FCC unit, sending it to a metals recovery unit, and perhaps recycling back to the FCC unit. A multistage procedure removes much of the metals content and restores much of the original activity of the catalyst. A catalyst demetallization process is discussed more fully in U.S. Pat. No. 4,686,197, and EP 0 252 659 Al.

Another approach has been to modify the FCC catalyst, or provide an additive catalyst, which can trap the nickel/vanadium components in the feed. This material, sometime referred to as a "getter" or "scavenger" preferentially adsorbs metals from the feed, so that they do not remain in the feed to be adsorbed by the FCC catalyst. Such a scavenger was disclosed by Wormsbecher et al, in a paper presented at the Ninth North American Catalyst Society Meeting, Houston, Tex., Mar. 18-21, 1985.

Most refiners also practice careful catalyst inventory control when cracking heavy feeds. Catalyst removal rates of 1-2 wt % a day are typical in FCC units, for catalyst activity. When heavy, metals laden feed is used, catalyst addition rates may double or quadruple to maintain a low level of metals in the FCC catalyst inventory.

Unfortunately, all of these solutions to the problems of too much metal in the feed have their drawbacks. In general they allow the problem to be created and then try to cope with it later. Thus, most of the solutions allow the catalyst to be poisoned and then try to cope with it by metals passivation, dumping catalyst and replacing it more frequently, or removing a slip stream of the circulating catalyst and cleaning it up and returning it to the unit.

Addition of "getter" materials, which have an affinity for Ni, V and other impurities (including coke precursors) to the catalyst is helpful, but the getters do not function as efficiently as desired. These getter additives have a size similar to that of FCC catalyst (to remain in the unit) and their surface area is similar to that of the FCC catalyst. The FCC catalyst is always present in excess, and the FCC catalyst competes with the additives for the metal in the feed. Unless large concentrations of getter additive are present (which dilutes the cracking catalyst) a lot of metal is still deposited on the cracking catalyst. The metal captured by the getter additive also remains in the unit, and may form vanadic acid. The metals that accumulate on the getter, or the vanadic acid, may transfer or migrate to or attack the FCC catalyst. The metals on the getter can create a disposal/toxic waste problems, in addition to diluting the cracking catalyst.

I realized it would be better to deal with the problem of too much metal in the feed by attacking the problem at its source, i.e., intercept metals before they could deposit on the catalyst. Existing feed demetallation technology was inadequate. Low cost approaches such as guard beds did not work well and more effective methods (expanded bed hydrotreaters or vaporization demetallation) cost too much. These expensive "upstream" or feed pretreatment technologies will be briefly reviewed.

Guard bed treating of the feed upstream of the FCC or TCC process has never been too successful because at the relatively low temperatures of the hydrocarbon feed it is difficult to remove all of the metals from the FCC feed. Much of the metal content of the feed is dissolved, so conventional filtration does not remove it. The metals can be removed to some extent by treatment with ion exchange resins, or acids or bases, but none of these treatments are completely satisfactory. All allow a significant amount of metal to get past the feed pretreatment step and contaminate the FCC catalyst. Such processes could probably be improved somewhat by going to more severe conditions, i.e., higher pressures, higher temperatures, or both, but that adds considerably to the capital and operating expense.

Expanded bed, high pressure hydrotreating processes such as H-Oil and LC Fining are robust and efficient. These processes not only remove metals and sulfur, but hydrogenate heavy aromatics to form more crackable compounds which are readily upgraded in FCC units. The capital and operating expenses are high, primarily because of the high pressures (1000–2000 psig) and high hydrogen consumptions required. Their use can never be justified upstream of a catalytic cracking unit solely for metals removal. A cheaper alternative is used in most refineries, coking or vaporization demetallation.

Coking is an efficient method of removing metal from heavy oils. Time and temperature cause 20–30% of the oil, and essentially all of the metals, to be rejected as coke, producing a demetallized vapor product of relatively low quality. The high temperatures thermally, rather than catalytically, crack the feed to lighter products containing large amounts of dienes. Coker naphtha is not used as gasoline blending stock, because it forms gum. It can not be conventionally hydrotreated, because gum formation will plug up the heat exchangers upstream of the hydrotreater. The coker gas oil is also of low quality.

Vaporization demetallation is another approach to dealing with heavy feeds. A two-stage catalytic cracking process, or more strictly speaking a demetallation stage followed by a more conventional catalytic cracking stage, cleans up the FCC feed.

A heavy feed, usually most of which is resid or metals contaminated feed, contacts a hot, relatively low activity or even inert material in a fluidized bed contact zone which looks like an FCC reactor but is not, because only thermal reactions occur. This preliminary contact stage removes most of the metals and Conradson Carbon Residue (CCR) materials and cracks some of the extremely large molecules to a somewhat smaller size, which can be cracked in the next stage by the large pore zeolite cracking catalyst. The feed, after vaporization demetallation, is charged to a conventional catalytic cracking unit. The preliminary demetallation reactor has a size, cost and complexity approaching that of a conventional cat cracker. The yields, overall, are better than pure coking but generally somewhat worse than conventional FCC processing of small amounts of resid blended into conventional FCC feeds. Details of one such process, sometimes referred to as the ART process, are disclosed in U.S. Pat. No. 4,263,128 (Bartholic). A related approach is that of U.S. Pat. No. 4,469,588. Both of these patents are incorporated by reference.

To summarize the state of the art, there is much technology (LC Fining, coking) effective for removing metals from FCC feed, but the capital and operating expenses are too high. Low cost approaches (guard bed or demetallizing additives) either do not remove enough metal, or the removal is so slow that excessive amounts of additive are needed, which dilutes the catalyst.

I wondered if there was a way to promote porphyrin demetallation reactions, and perhaps even promote some limited cracking of extremely large molecules in heavy hydrocarbon feeds, ideally at temperatures and pressures which were compatible with catalytic cracking units. If these reactions could be promoted, it would then be possible to make better use of existing low cost, but relatively ineffective metals removal techniques. It might even be possible to reduce the viscosity of these heavy feeds, and make them easier to crack in an FCC unit.

I realized that most metals removal techniques relied on thermal decomposition of metallo-porphyrins and porphyrin like materials as the primary mechanism for removing metals. High temperatures in coking, or in vaporization demetallation, promoted rapid demetallation, but degraded the products. Low temperature processes such as guard beds were never too effective because much of the metals content of heavy feed is stable at the relatively low temperatures used. Operating a guard bed at FCC temperatures (i.e., vaporization demetallation) would be effective but would be similar to vaporization demetallation, and involve capital and operating expenses approaching those of a conventional FCC.

Low temperature process worked too slowly, while high temperature processes (coking) degraded the product thermally. It was necessary to somehow achieve decomposition of metallo-porphyrins at lower temperatures. In this way, reliance on thermal decomposition, which requires excessive preheat temperature to work, and requires large capital expenditures, could be avoided. Guard beds could be made effective, and/or conventional metals getting additives or scavengers could be made more efficient. Ideally, a way would be found to not only promote porphyrin degradation, but also achieve some measure of catalytic cracking of large molecules, so that reliance on thermal cracking of large molecules could be reduced or eliminated.

I discovered a way to speed up the decomposition of metallo-porphyrins and/or extremely large molecules associated with resids and heavy feeds which did not require extreme temperatures or high pressures. Adding acidic sulfur compounds to the heavy feed produces acid sites which increase the rate of decomposition of metallo-porphyrins and porphyrin like materials and promotes more efficient removal of metals from heavy feed. These acid sites also do a limited amount of cracking of heavy feed. The "catalyst" used, sulfur compounds, does not damage the cracking catalyst, and is easily handled by downstream processing equipment.

BRIEF SUMMARY OF THE INVENTION

Accordingly, the present provides a process for decomposing metallo-porphyrins and porphyrin like materials dissolved or suspended in a heavy feed which comprises dissolving in the heavy feed a reactive sulfur compound and thermally treating the feed for a time and at a temperature sufficient to at least partially decompose metalloporphyrins, while maintaining the feed at a pressure below 200 psig and sufficient to maintain a majority, by weight, of said feed in the liquid phase, to produce a treated feed comprising catalytically decomposed metalloporphyrins; contacting and catalytically cracking said thermally treated feed by contact with: a contact material having a relatively high affinity for metals in decomposed metalloporphyrins, and depositing metals on the contact material to produce a demetallized heavy liquid feed; and a cracking catalyst and catalytically cracking said heavy liquid feed in the absence of added hydrogen with said cracking catalyst in the absence of added hydrogen at catalytic cracking conditions to produce a catalytically cracked product.

In another embodiment the present invention provides a process for catalytic cracking of a heavy hydrocarbon feed containing at least 1.0 wt % Conradson Carbon Residue and at least 10 wt % of a resid fraction boiling above about 1000 F. comprising: adding to and dissolving in the heavy feed 0.01 to 15 wt % of a reactive, acidic sulfur compound; preheating, in a catalytic cracking preheater means, said heavy feed and dissolved acidic sulfur compound for a time and at a temperature sufficient to induce acid catalyzed cracking of at least a portion of said resid fraction, while maintaining a pressure below 100 psig and sufficient to maintain a majority, by weight, of said feed in the liquid phase, to produce a preheated feed comprising acid cracked resid; catalytically cracking, in the absence of added hydrogen, said preheated feed by contact with a catalytic cracking catalyst in a catalytic cracking means operating at catalytic cracking conditions to produce a catalytically cracked product.

DETAILED DESCRIPTION

FCC-TCC Units

Any conventional, or hereafter developed, FCC or TCC unit can be used, such as the FCC units described in U.S. Pat. No. 3,821,103 and U.S. Pat. No. 4,422,925, which are incorporated by reference. The cracking unit, per se, forms no part of the present invention.

The process works especially well with FCC units designed to work with heavy, fast settling additives, such as that of Chen et al, U.S. Pat. No. 4,895,636, which is incorporated by reference. This kind of FCC unit operates with a modest amount of a fast settling metals getting additive in inventory. The additive accumulates in the base of a riser reactor. The process of the present invention allows demetallation to proceed more completely, or at lower temperature, in a demetallation section in the base of, or beneath, the riser.

The process of the present invention may also be used upstream of an FCC or TCC cracker, to produce a heavy feed with a reduced metals content and/or of reduced viscosity.

FEEDSTOCKS

The process works well with conventional feedstocks and with heavier feedstocks. It permits the use of much more resid when a mixture of conventional feed and resid is used.

The process of the present invention permits unusual, metals laden feeds such as tar sands, shale oil, and similar materials which contain a large amount of metals, and/or poisons to be processed in a catalytic cracking unit, with a high temperature and/or high pressure pretreatment process such as disclosed in U.S. Pat. No. 4,430,206. When processing severely metal contaminated stocks such as shale oils it will probably be beneficial to add not only $H_2S$ but also a small size getter material to the feed.

TWO-STAGE CRACKING PROCESSES

The process of the present invention may also be useful in two-stage processes such as vaporization demetallation wherein a first stage demetallizes heavy resid feed, while a second stage engages in more conventional catalytic cracking. The first stage can be run at greater throughputs, or at a reduced temperature, or at a lower particulate:oil ratio when a reactive sulfur compound is added to the feed.

In this way much of the product degradation associated with existing thermally promoted degradation processes (vaporization demetallation) can be avoided. Capital costs will be essentially unchanged, but operating costs somewhat reduced, and product quality improved, by virtue of sulfur addition to the feed and lower temperature operation.

REACTIVE SULFUR COMPOUND

It is essential that the reactive sulfur compound be added to the feed prior to catalytic cracking thereof. The preferred reactive sulfur compound is hydrogen sulfide. This material has a vapor pressure similar to that of propane, and readily dissolves in, or can be absorbed by, the heavy oil feed.

The sulfur compound is preferably added to the hydrocarbon feed upstream of the heat exchanger or preheater used to bring the catalytic cracking unit feed to the temperature necessary for it to enter the catalytic cracking unit. Depending on the corrosion resistance of the piping, and the amount and corrosivity of the reactive sulfur compound added, it may be beneficial to add the sulfur compound immediately after the crude oil feed is fractionated in the main fractionator. Thus, some porphyrin decomposition and/or feed cracking can be accomplished in the piping intermediate the crude column and the catalytic cracking unit. When acidic, corrosive sulfur compounds such as hydrogen sulfide are used, it may be beneficial to use stainless steel or other corrosion resistant material in the piping to allow maximization of residence time at high temperature, while minimizing damage to equipment.

To minimize corrosion from the reactive sulfur compound, it may be added downstream of the preheater, or heat exchanger, used to bring the catalytic cracking unit feed up to the desired temperature. It may be beneficial to provide some increased residence time intermediate the preheater and the reactor. This can be done by providing a large tank or a relatively large, serpentine coil, or combination of both to provide the residence time at elevated temperature needed to promote rapid deactivation of metallo-porphyrins and porphyrin like materials. Where sufficient amounts of $H_2S$ are added, or where there is sufficiently high temperature or long enough residence time, it may be possible to precipitate some of the metallo-porphyrins and porphyrin like materials upstream of the catalytic cracking unit, and recover these by filtration upstream of the catalytic cracking unit. Automatic, self-backwashing filters in parallel such as are used upstream of the crude unit, may be used to remove metal precipitates formed as a result of treatment with reactive sulfur compound. Cyclone fuel filters, such as those used aboard marine engines may also be used to continuously remove all or some portion of the metal precipitates.

A certain minimum amount of reactive sulfur compound is needed to provide the necessary acid cracking of metallo-porphyrins. When $H_2S$ is the reactive sulfur compound added, at least 0.1–15 wt. % $H_2S$ must be added to the heavy oil. Preferably, 0.1–10 wt % $H_2S$ is present. A small amount of $H_2S$ may also be present because of unusual crudes and conventional operating steps, or more conventional crudes and somewhat unusual operating conditions, e.g., high temperatures in a column can cause a breakdown of sulfur compounds to produce modest amounts of $H_2S$ on storage. Such incidental $H_2S$ would of course be beneficial to the practice of the present invention but is usually removed as rapidly as it is formed by conventional flashing and/or distillation steps. Therefore the amounts of $H_2S$ referred to in the claims are the amounts of $H_2S$ added, rather than that which is present or which could be formed if all sulfur compounds in the feed were broken down into $H_2S$.

It is essential that the reactive sulfur compound be essentially completely dissolved in or miscible with the hydrocarbon feed. When $H_2S$ is added, it may be added as a liquid, under pressure, but preferably is added as a mixture of $H_2S$ and other materials. Relatively impure $H_2S$ streams are available from many sources within a refinery, and recycling these streams to the catalytic cracking unit to mix with the feed is an excellent use of these materials and permits recovery of valuable hydrocarbon components that may be in these dirty streams.

There is an additional benefit to adding relatively large amounts of $H_2S$ and/or using an $H_2S$ stream containing large amounts of hydrocarbons. The $H_2S$ and other hydrocarbons can lower the viscosity of the feed, reduce the density of the heavy feed, and improve and promote mixing and intimate contact of the $H_2S$ with the heavy oil. The benefits are somewhat analogous to those achieved in miscible CO2 flooding of heavy oil fields It is detrimental to add the $H_2S$ with something which will immediately vaporize and prevent contact of $H_2S$ with metallo-porphyrins in the liquid feed. Thus, it is generally unsuitable to simply recycle sour water streams, containing $H_2S$, to the feed to the unit. These sour water streams will vaporize to form steam.

METAL SCAVENGING ADDITIVE

The reactive sulfur compound promotes both cracking and porphyrin (and porphyrin like material) decomposition. The benefits from either effect are believed to be sufficient to justify use of the invention. Metals removal is usually the most difficult problem, and use of a metal absorbent or metal scavenging additive with or downstream of the practice of the present invention is preferred.

Any material which can efficiently adsorb nickel/vanadium can be used as the metal scavenging additive. Preferably the additive has physical and chemical properties which permit its use as part of the catalyst inventory of an FCC or TCC without adversely affecting the cracking process.

Preferred getter materials are those having greater affinity for metals than the cracking catalyst used in the system. Especially preferred for use in FCC are finely ground particles of coke or high surface area alumina.

The getter additive need not have any strength to speak of. In fact is is a benefit if a relatively soft, friable getter material is used, because such materials will quickly break down in the erosive environment of the catalytic cracking unit and be removed. Preferred materials, and physical properties are:

1) $Al_2O_3$
2) Coke
3) Clay
4) MgO
5) Carbonaceous materials (see note below)
6) Bauxites
7) $Mg_2(SiO_2)_3$ (Sepiolite)

Note: carbonaceous materials include coal charcoal, wood charcoal, or peat charcoal, or activated carbons made from coal, peat, wood etc. The materials are highly effective. They usually have a somewhat lower density, typically an ABD of 0.5 to 0.8 g/cc.

| | broad | preferred | most preferred |
|---|---|---|---|
| particle size | 10–100 | 20–50 | 39–40 |
| density g/cc | 0.4–5 | 0.5–4 | 0.6–3 |
| attrition indices | 9–100 | 9–80 | 10–20 |

Attrition index is measured by placing a 7 cc catalyst sample in one inch i.d., "U" tube. The catalyst is contacted with an air jet formed by passing humidified (60%) air through a 0.07 inch nozzle at 21 liter/min. for one hour. The attrition index (AI) can be calculated from the fine fractions (0–20 microns) product and packed density correction factor (P.D.).

$$AI = 100 \times (P.D.) \frac{\text{Wt. \% fines } AA - \text{wt. \% fines } BA}{100 - \text{wt. \% fines } BA}$$

where AA = After Attrition; BA = Before Attrition; and fines = wt. % (0–20 microns).

If 7 cc of soft material having an average particle size above 20 microns is put in the "U" tube, all of it is attrited to "fines" of 0–20 microns in an hour, then the attrition index will be 100. Typical FCC catalyst has an attrition index of 6–8.

The amount of getter material added is determined more by economics than anything else. The most efficient use of getter material will be adding the smallest amount. This ensures that the getter material is fully loaded with metal. It will usually mean that a significant amount of metal bypasses the getter material and will be deposited on the FCC or TCC catalyst. Depending on the value of eliminating more metal from the feed, it may be desirable to operate with more or less getter material.

At least 25% of the metals present in the feed should be removed on the getter material. Preferably 50% to 90% of the metals in the heavy feed are deposited on the getter material.

The feed may simply contain from 0.01–5 wt. % getter material, and preferably from 0.1–1 wt. % getter material.

The getter material can comprise conventional FCC catalyst, fines recovered from downstream operations or fines obtained from a catalyst manufacturer.

These additives or getter materials are not, per se, novel. The problems of metals deposition are well known and catalyst manufacturers have developed catalysts which contain elements which are effective for scavenging metals. It is also known that alumina, especially soft, highly porous forms of alumina such as low density alpha-alumina, are effective metal scavenging additive, that metals contained in the feed will preferentially deposit upon the metals scavenging additive.

Suitable metal scavenging additives are those with a partitioning coefficient for vanadium in excess of 2, and preferably in excess of 10.

The affinity of the materials for metals has been quantified in terms of partitioning coefficients. Kv or Kc represents ratio of absolute concentration of vanadium or coke on the substrate materials versus that on the cracking catalyst; while Kve and Kce denote the same ratio normalized with respect to the external surface area of each component, respectively. Kv and Kve values for the alumina are 50.8 and 206, respectively. The corresponding values for the silica are 1.9 and 66.

The process of the invention speeds up the decomposition of many of the metal containing species in heavy feeds, and permits these conventional, per se, vanadium scavenging materials to do their job more quickly and effectively. Metal scavengers are still necessary for efficient demetallation, because if not present, the metal compounds decompose (at an accelerated rate) and deposit on the conventional, zeolite based cracking catalyst.

The metals in the feed that pass by the metal scavenging additive end up, almost stoichiometrically, on the solids in the catalytic cracking unit. There will still be benefits if $H_2S$ addition to the cat cracking feed is practiced without metal scavengers, i.e., some cracking of heavy feeds will occur, and the reduced weight of metallo-porphyrins and porphyrin like materials and asphaltene compounds are easier to upgrade in the FCC unit than those which have not been given a preliminary cracking treatment with $H_2S$.

The most effective use of metals scavenging additive is in an FCC which allows preferential contact of metal scavenging additive prior to contact with conventional catalyst. Heavy, dense additive can collect in the base of a riser, forming a dense phase bed of additive for metals removal. Preferably a two-stage riser cracking reactor is used, with heavy feed contacting a metals scavenger in the base of a riser, and conventional cracking catalyst higher up in the riser. Addition of $H_2S$, or similar sulfur compound to the feed, promotes the decomposition of metallo-porphyrins and porphyrin like materials enough to permit effective demetallation to be achieved with extremely short residence times, or at much lower temperatures, in such a riser.

EXPERIMENTS

Several experiments are reported below. The first set shows acidic sulfur compounds promote decomposition of metal species, at temperatures below that of the feed to conventional FCC units. Operation at higher temperatures, only slightly higher than conventional FCC feed preheat temperatures, achieves some cracking of heavy oil. The second set of experiments did not involve $H_2S$ addition, but shows the selective demetallation that can be achieved in with conventional metal getters in a dense phase fluidized bed.

$H_2S$ PROMOTED DEMETALLATION/CRACKING

The following examples show that hydrogen sulfide promotes decomposition of metal containing molecules and also demonstrates some conversion of heavy oils by acid cracking activity. Since 10–60% of the metals coordinated by oil molecules are porphyrin type structures, model compound porphyrins were studied.

LOW TEMPERATURE DEMETALLATION

This first set of experiments was run to determine if decomposition of porphyrins could be achieved at relatively low temperatures. Most heavy hydrocarbon liquid streams in refineries have a significant residence time at a temperature of 150–250 C, usually because they are heated to this temperature for fractionation. Most porphyrins are stable at these temperatures, i.e., refluxing a sample of a porphyrin at 168 or 240 C. for a day in a hydrogen atmosphere led to no measurable decomposition. By substituting $H_2S$ for hydrogen, and rerunning the experiments, a significant amount of decomposition was achieved, as shown in Table 1, below.

Both octaethylporphyrin and tetraphenylporphyrin were refluxed in trimethylbenzene or 1-methylnaphthalene solvents, at atmospheric pressure with hydrogen sulfide at increasing temperatures. Both increasing temperature, and the presence of $H_2S$ increased the rate of porphyrin decomposition.

TABLE 1

| Atmospheric Pressure Reflux with $H_2S$ | | |
|---|---|---|
| Metalloporphyrins | | |
| Ni (OEP) | Reflux 168° C.[a] $H_2S$/1 Day | 15% Decomposition |
| Ni (OEP) | Reflux 240° C.[b] $H_2S$/1 Day | 50% Decomposition |
| VO (TPP) | Reflux 240° C. $H_2S$/1 Day | 70% Decomposition |
| VO (TPP) | Reflux 240° C. $H_2$/7 Days | 20% Decomposition |
| Ni (TPP) | Reflux 240° C. $H_2S$/1 Day | 5% Decomposition |
| Free Base porphyrin | | |
| H2 (TPP) | Reflux 240° C.[a] $H_2S$/1 Day | 90+% Decomposition |

[a]Reflux in trimethylbenzene.
[b]Reflux in 1-methylnaphthalene.

I believe that the reaction pathway for this decomposition involves $H_2S$ addition, which leads to thermal cleavage of saturated bonds with polypyrrolic formation. It is possible that some other reaction pathway is involved. The experiments were designed to show the invention works, not to prove the reaction pathway, so the invention should not be considered limited by my proposed reaction pathway.

Note that when VO(TPP) is refluxed at 240 C. for 7 days in hydrogen, rather than hydrogen sulfide, only a small amount (20% of metalloporphyrin degradation occurs. Also, the free base unmetalallate porphyrin, H2(TPP) is rapidly decomposed at 240 C. in the presence of hydrogen sulfide. This indicates that large aromatic type compounds can be degraded by $H_2S$.

The next set of experiments was run at somewhat higher temperatures, somewhat above the feed preheat temperature of conventional FCC units, but easily achievable in refineries. I knew that at some point thermal decomposition proceeded rapidly, and wanted to learn the promoting effect, if any, of $H_2S$ on porphyrin decomposition at these temperatures.

Comparisons between thermal treatment with hydrogen and hydrogen+hydrogen sulfide showed that hydrogen sulfide accelerates petroporphyrin degradation at temperatures between 750°–850° F.

TABLE 2

| MICROGRAMS PETROPORPHYRIN PER GRAM OF OIL | | | |
|---|---|---|---|
| Fraction | | NM | micro g/g |
| Arabian Heavy 1075° F.+ Resid | | 455 | 36.4 |
| $C_5$-soluble | | 432 | 13.8 |
| $C_5$-insoluble | | 520 | 73.0 |
| LHSV | Processed Oil | NM | micro g/g |
| 5.5 | $H_2$, 850° F. | 455 | 29.0 |
| | $C_5$-soluble | | 00.0 |
| | $C_5$-insoluble | | 35.6 |
| 5.5 | $H_2$ + $H_2S$ (20%), 850° F. | 455 | 27.0 |

TABLE 2-continued

| | | | |
|---|---|---|---|
| | $C_5$-soluble | | 00.0 |
| | $C_5$-insoluble | | 35.6 |
| 1.0 | $H_2$, 850° F. | 455 | 21.0 |
| 1.0 | $H_2 + H_2S$, 850° F. | 455 | 20.0 |
| 0.3 | $H_2$, 750° F. | 455 | 35.1 |
| 0.3 | $H_2S$, 750° F. | 455 | 24.7 |

Where NM refers to visual absorption nanometers (NM), and micro g/g is the micrograms, or g * $10^{-6}$ of petroporphyrin per gram of oil fraction studied.

The next set of experiments was run to determine the extent to which $H_2S$ promoted cracking reactions could be substituted for, or used in conjunction with, thermal cracking.

Arab Heavy 1075°F+ resid was thermally treated in a visbreaker with $H_2$ addition, then the experiments repeated with 20% $H_2S$ added to the $H_2$. Table 3 shows the advantages of $H_2S$ addition for added conversion and H/C mole ratio increases.

Similar advantages could be achieved from $H_2S$ addition to heavy oil feed entering an FCC preheater.

TABLE 3

ARAB HEAVY 1075° F.+ RESID

| | | | | | | | | | | |
|---|---|---|---|---|---|---|---|---|---|---|
| | 1. Viscosity Reduction 850° F., 1000 psig, LHSV = 1.0 | | | | | | | | | |
| Control | 125 cs (100° C.) | | | | | | | | | |
| Control + $H_2S$ where Arab Heavy resid is 2850 cs (100° C.) | 58 cs (100° C.) | | | | | | | | | |
| | 2. Conversion to 1075° F.− 850° F., 1000 psig, LHSV = 1.0 | | | | | | | | | |
| Control | 42.7% conversion | | | | | | | | | |
| Control + $H_2S$ | 61.3% conversion | | | | | | | | | |
| | 3. H/C Mole Ratio for Total Liquid Product 850° F., 1000 psig, LHSV = 1.0 | | | | | | | | | |
| Control | 1.42 H/C mole ratio | | | | | | | | | |
| Control + $H_2S$ | 1.44 H/C/ mole ratio | | | | | | | | | |
| | 850° F., 500 psig, LHSV = 0.5 | | | | | | | | | |
| Control | 1.37 | | | | | | | | | |
| Control + $H_2S$ | 1.42 | | | | | | | | | |
| | 4. Effect of $H_2S$ on average molecular weight | | | | | | | | | |
| Processing Conditions | -0- | $H_2S$ | -0- | $H_2S$ | -0- | $H_2S$ | -0- | $H_2S$ | -0- | $H_2S$ |
| LHSV | 5.5 | 5.5 | 1.0 | 1.0 | 0.3 | 0.3 | 1.0 | 1.0 | 0.5 | 0.5 |
| Temp. F. | 850 | 850 | 850 | 850 | 750 | 750 | 850 | 850 | 850 | 850 |
| PSIG | 500 | 500 | 500 | 500 | 500 | 500 | 1000 | 1000 | 500 | 500 |
| 30 ml C7/g oil | | | | | | | | | | |
| C7 Ins. | 19.1 | 16.1 | 21.0 | 19.2 | 14.7 | 15.1 | 18.9 | 18.3 | 22.4 | 18.5 |
| Mol Wt | 2168 | 1930 | 1834 | *b | 2568 | 2302 | 1937 | 1691 | 2227 | 1473 |

Where C7 Ins refers to that material precipitated by addition of 30 ml of normal heptane per gram of oil sample. The molecular weights, Mol Wt, were determined by Galbraith Labs, as the average molecular weight (THF solvent). In one test, *b, there was insufficient sample available for measurement.

By way of comparison, the Arab Resid feed contained 15.0 wt % C7 insolubles, and this insoluble material had an average molecular weight of 3021.

These experiments show the effectiveness of $H_2S$ at promoting cracking at high temperatures and porphyrin decomposition at lower temperatures. Merely adding $H_2S$ to the heavy feed upstream of the preheater will induce beneficial reactions (primarily viscosity reduction, believed due to cracking of at least some of the extremely large molecules in the feed) but will not solve the metals problem. The porphyrins decompose more rapidly, but would still deposit their metals on the FCC catalyst in the base of the riser reactor, so there would be no change in metals loading on the FCC catalyst.

EXPERIMENTAL—METAL PARTITIONING

This is not an example of the present invention, it is presented to show that relatively fast settling solids can be used to preferentially remove metals from FCC feeds and reduce metals deposition on FCC catalyst. It is abstracted from U.S. Pat. No. 4,895,636, which is incorporated herein by reference.

Table 1 of '636 shows the results of metal partitioning between the FCC catalyst and various additives such as alumina.

Kve and Kce are the ratios of partitioning coefficients which have been normalized with respect to the external surface area of each component, respectively. The calculation of Kve and Kce for these mixtures is shown in U.S. Pat. No. 4,895,636.

The vanadium contents for FCC catalyst fines (140/170 mesh) and alumina (40/80 mesh) were 5 and 254 ppm respectively. The alumina was believed to segregate somewhat in the dense fluidized bed at the test conditions used, 500 C., 1 LHSV, 5900 SCF/b helium, with 5 g each of catalyst and alumina. The large difference in metal loading was due to a combination of two factor, formation of an alumina rich phase within the fluidized bed and also the high affinity of alumina for vanadium.

In this bench scale fluid bed, the size and density of the particles influence the mixing of the two component system. At a given fluidizing velocity heavier particles tend to remain on the bottom of the bed while more readily fluidizable component remains on the top, stratifying the two materials. The effect of such a non-uniform two-component bed is to mimic two stage demetallation units and allow vanadium to deposit on the first component it sees. At typical FCC conditions (538.C), thermal reaction alone are sufficient to crack vanadium containing porphyrin or naphthene structures to permit metal deposition.

These experiments show that demetallation technology can be effective even without $H_2S$. The effectiveness of scavengers will be significantly increased with $H_2S$ addition, allowing porphyrin decomposition to proceed at a significantly lower temperature or more completely at existing temperatures. In this way two stage demetallation could be conducted at lower temperatures, or with an even shorter residence time, in the base of a riser reactor such as that shown in U.S. Pat. No. 4,895,636.

Alternatively, modest amounts of finely divided metal getter and $H_2S$ could be added to the FCC feed and allowed to react in the preheater, so that a large portion of the coordinated metals could be removed upstream of, or during dispersion into, the base of a conventional riser cracking FCC. Any porphyrins not degraded catalytically by the presence of the $H_2S$ will be rapidly thermally degraded in the base of the riser by the cracking temperature, and the finely divided metal scavenger will be available to react with metals from thermally decomposed porphyrins.

I claim:

1. A process for decomposing metallo-porphyrins and porphyrins dissolved or suspended in a heavy feed and subsequently cracking said heavy feed which comprises dissolving in the heavy feed hydrogen sulfide and thermally treating the feed for a time and at a temperature sufficient to at least partially decompose metalloporphyrins, while maintaining the feed at a pressure below 200 psig and sufficient to maintain a majority, by weight, of said feed in the liquid phase, to produce a treated feed comprising decomposed metalloporphyrins;

contacting and fluidized catalytically cracking said thermally treated feed by contact with:

a contact material having an affinity for metals in decomposed metalloporphyrins, and depositing metals on the contact material to produce a demetallized heavy liquid feed; and a zeolite containing cracking catalyst; and catalytically cracking said heavy liquid feed in the absence of added hydrogen with said zeolite containing cracking catalyst at fluidized catalytic cracking conditions including an initial mixing temperature of catalyst and said heavy liquid feed of about 1,000 F. up to about 1150 F. to produce a catalytically cracked product.

2. The process of claim 1 wherein the hydrogen sulfide partial pressure is less than 15 psi during contact of said heavy feed with said contact material having an affinity for metals.

3. The process of claim 1 wherein the pressure is less than 15 psig during contact of said heavy feed with said contact material having an affinity for metals.

4. The process of claim 1 wherein the contact material is selected from the group of clay, alumina, petroleum coke, coal, coal tar and coke.

5. The process of claim 1 wherein the contact material has a vanadium selectivity $K_v$ of at least 10.

6. The process of claim 1 wherein the contact material is added to the feed upstream of the catalytic cracking means, and is present in an amount equal to about 0.01 to 10 wt. % of the feed.

7. The process of claim 1 wherein the contact material is part of said catalytic cracking catalyst.

8. The process of claim 1 wherein the cracking catalyst has an average particle size of 50–100 microns and the contact material has an average particle size which is at least 50% larger than the cracking catalyst.

9. The process of claim 1 wherein 0.01–15 wt. % $H_2S$ is dissolved in the heavy feed.

10. The process of claim 1 wherein the heavy feed is preheated in a preheater means prior to introduction into the catalytic cracking means and the time and temperature of preheating, as measured by equivalent reaction time at 800° F., ranges from 25–500 ERT seconds.

11. The process of claim 10 wherein the equivalent reaction time at 800 F. is 50–250 ERT seconds.

12. The process of claim 10 wherein hydrogen sulfide is added upstream of the preheater means and the preheated feed is subjected to a flash vaporization to remove at least a majority of hydrogen sulfide and a majority of the removed hydrogen sulfide is recycled and dissolved in the heavy feed upstream of the preheater means.

13. A process for fluidized catalytic cracking of a heavy hydrocarbon feed containing at least 1.0 wt % Conradson Carbon Residue and at least 10 wt % of a resid fraction boiling above about 1000 F. comprising:

dissolving in the heavy feed 0.1 to 15 wt % hydrogen sulfide;

preheating, in a catalytic cracking preheater means, said heavy feed and dissolved hydrogen sulfide for a time and at a temperature sufficient to induce acid catalyzed cracking of at least a portion of said resid fraction, while maintaining a pressure below 100 psig and sufficient to maintain a majority, by weight, of said feed in the liquid phase, to produce a preheated feed comprising acid cracked resid;

catalytically cracking, in the absence of added hydrogen, said preheated feed by contact with a fluidized catalytic cracking catalyst in a fluidized catalytic cracking means operating at fluidized catalytic cracking conditions including a catalyst and preheated feed contact temperature of about 1,000 F. up to about 1150 F. to produce a catalytically cracked product.

14. The process of claim 13 wherein the time and temperature of preheating, as measured by equivalent reaction time at 800° F., ranges from 50–1000 ERT seconds.

15. The process of claim 14 wherein the ERT is 50–500 seconds.

16. The process of claim 13 wherein the preheater pressure is equal to the pressure in the catalytic cracking reactor means plus any pressure drop associated with pipes and valves connecting the preheater to the cracking reactor means.

17. The process of claim 13 wherein 1 to 30 wt % of the resid fraction is acid cracked in the preheater means.

18. The process of claim 13 wherein 0.1 to 10 wt % $H_2S$ is dissolved in the feed.

19. The process of claim 1 wherein 0.1 to 10 wt % $H_2S$ is dissolved in the feed.

* * * * *